US007661969B2

(12) United States Patent
Nagano et al.

(10) Patent No.: US 7,661,969 B2
(45) Date of Patent: Feb. 16, 2010

(54) LEVER FITTING CONNECTOR

(75) Inventors: Toru Nagano, Makinohara (JP); Hideki Honma, Tokyo (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/238,487

(22) Filed: Sep. 26, 2008

(65) Prior Publication Data

US 2009/0093145 A1 Apr. 9, 2009

(30) Foreign Application Priority Data

Oct. 5, 2007 (JP) ..... 2007-261958

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS 7,150,640 B2 * 12/2006 Fukui et al. ..... 439/157

7,201,591 B2 * 4/2007 Fujii ..... 439/157

FOREIGN PATENT DOCUMENTS

JP 2000-252007 A 9/2000

* cited by examiner

*Primary Examiner*—Phuong K Dinh
(74) *Attorney, Agent, or Firm*—Sughrue Mion, PLLC

(57) ABSTRACT

A lever fitting connector includes: a connector having a housing; a lever pivotally mounted on the housing and rotated to connect/disconnect the connector to/from a mating connector; a center portion provided on the lever to serve as a pivot of the lever; a center supporting portion provided on an outer surface of the housing at a center along a direction perpendicular to a connecting direction of the connector toward the mating connector so as to pivotally support the center portion; a pair of expanding-prevention portions symmetrically provided with respect to a virtual line parallel to the connecting direction of the connector through the center supporting portion so that the lever is prevented from expanding to outside of the housing.

13 Claims, 9 Drawing Sheets

LEVER FITTING CONNECTOR

BACKGROUND OF THE INVENTION

1. Technical Field

The present invention relates to a lever fitting connector for engaging a male connector with a female connector or disengaging the male connector from the female connector with a low strength by a rotating operation of a lever.

2. Background Art

In the past, there has been adopted a lever fitting connector to reduce a engaging operational strength by using a lever when connecting male and female connectors each having multiple terminals (see, for example, Patent Reference 1).

The above-mentioned lever fitting connector is as shown in FIG. 11. The lever fitting connector 100 shown in FIG. 11 includes a male connector 121, a lever 122 which is pivotally mounted on a boss 127 provided on side faces 125 of this male connector 121, and a female connector 123 to be connected to the male connector 121. The lever 122 has a matched pair of right and left side walls 128 and operational part 129 for connecting the side walls at a rear side.

In the above-mentioned lever fitting connector 100, when the operational part 129 of the lever 122 is pressed toward the female connector, the male connector 121 is contained into a hood portion 132 of the female connector 123 to connect the male connector 121 to the female connector 123.

In addition, the above-mentioned lever fitting connector 100 is provided with disengagement-prevention ribs 126 extending in a fitting direction of the lever fitting connector 100 at end portions of the side faces 125 of the male connector 121 so as to prevent the lever from disengaging from the boss 127 due to the moment generated by the rotating operation of the lever 122. This disengagement-prevention rib 126 includes a long hole 126A extended along the fitting direction, and a projecting portion 128A, which is provided on a head of the side wall 128 and on a opposite side of the operational part 129 of the lever 122, is inserted into the long hole 126A. According the configurations, the pair of the side walls 128 of the lever 122 are prevented from expanding in a separating direction each other. Thus, it is possible to prevent the lever 122 from disengaging from the boss 127.

Further, the above-mentioned lever fitting connector 100 is provided with a balance defining piece 138, having a reactivity and a flexibility, which expands rearward, on a lower portion at a rear side of the lever 122 so as to keep a balance of the lever 122 until an early step of fitting the connectors 121, 123.

[Patent Reference 1] JP-2000-252007A

Since the above-mentioned lever fitting connector 100 is mainly used in a narrow space, such as a vehicle, etc., it could be difficult to operate the lever 122 depending on a rounding direction of the wires connected to the connectors 121, 123. Therefore, it has been desired to provide a lever fitting connector which adopts a reversible type capable of selecting a mounting direction of the lever 122 from right and left directions depending on the rounding direction of the wires.

In designing the reversible-typed lever fitting connector, the shape of the connector on which the lever is mounted is formed in symmetric with respect to a pivot line of this lever. However, in the above-mentioned lever fitting connector 100, the disengagement-prevention portion 126 extending in the fitting direction is provided on one ends of the side faces 125 of the male connector 121. If this disengagement-prevention portions is also provided on the other ends of the side faces 125 in symmetric, it could be a problem that the disengagement-prevention portion 126, positioned at a side of the operational part 129 of the lever 122, interferes the rotating operation of the lever 122. In this way, in a lever fitting connector having a preventing function of lever-disengagement, it has not been easy to provide a configuration capable of arbitrarily selecting a mounting direction of the lever from right and left directions.

Further, in the above-mentioned lever fitting connector 100, the balance defining portion 138 is provided to project toward a fitting clearance with the female connector 123. Thus, there has been a possibility that this balance defining portion 138 is broken, and stuck with the wires and the hood portion 132, etc. of the female connector 123.

SUMMARY OF THE INVENTION

An object of the present invention is to provide a lever fitting connector which has a function of preventing a lever-disengagement and is capable of arbitrarily selecting a mounting direction of a lever from a right direction and a left direction.

In order to achieve the above object, the present invention provides the following arrangements.

(1) A lever fitting connector, including: a connector having a housing; a lever pivotally mounted on the housing and rotated to connect/disconnect the connector to/from a mating connector; a center portion provided on the lever to serve as a pivot of the lever; a center supporting portion provided on an outer surface of the housing at a center along a direction perpendicular to a connecting direction of the connector toward the mating connector so as to pivotally support the center portion; a pair of expanding-prevention portions symmetrically provided with respect to a virtual line parallel to the connecting direction of the connector through the center supporting portion so that the lever is prevented from expanding to outside of the housing.

(2) The lever fitting connector according to (1), wherein the pair of the expanding-prevention portions are provided on one end of the housing in the connecting direction.

(3) The lever fitting connector according to (1), wherein the housing includes a lying wall parallel to the expanding-prevention portion; wherein edge portion of the lever is positioned between one of the expanding-prevention portions and the lying wall before rotating the lever; and wherein the edge portion of the lever is positioned between the other of the expanding-prevention portions and the lying wall when rotating the lever is finished.

(4) The lever fitting connector according to (1), wherein the housing includes a lying wall parallel to the expanding-prevention portion; wherein rotating operation of the lever is split into a first stage and a last stage; wherein edge portion of the lever is positioned between one of the expanding-prevention portions and the lying wall at the first stage; and wherein the edge portion of the lever is positioned between the other of the expanding-prevention portions and the lying wall at the last stage.

(5) The lever fitting connector according to (1), wherein the housing includes a lying wall parallel to the expanding-prevention portion; wherein a notch portion is formed on an outer edge of the expanding-prevention portion; and wherein a projection is projected toward an outside of the housing from an outer surface of the lever, and pressed and engaged with the notch portion so as not to rotate the lever.

(6) The lever fitting connector according to (5), wherein the projection is arranged closer to a center of the lever than to an outer edge portion of the lever close to the mating connector.

(7) The lever fitting connector according to (5), wherein a U-shaped groove is provided on the lever to surround the projection; and wherein a thickness of an inner portion of the U-shaped groove is made smaller than other portions of the lever to form a space between the inner portion of the U-shaped groove and the lying wall.

According to the above configurations, the center portion is provided on the lever to serve as a pivot of the lever, the center supporting portion is provided on the outer surface of the housing at the center along the direction perpendicular to the connecting direction of the connector toward the mating connector so as to pivotally support the center portion, and the pair of expanding-prevention portions symmetrically is also provided with respect to the virtual line parallel to the connecting direction of the connector through the center supporting portion so that the lever is prevented from expanding to outside of the housing. Further, the pair of the expanding-prevention portions may be provided on one end of the housing in the connecting direction. Further, the edge portion of the lever is positioned between one of the expanding-prevention portions and the lying wall at the first stage; and the edge portion of the lever is positioned between the other of the expanding-prevention portions and the lying wall at the last stage. Accordingly, since there is no possibility that the pair of the expanding-prevention portions interferes the rotating operation of the lever, it is possible to provide a lever fitting connector which has a function of preventing a lever-disengagement and is capable of arbitrarily selecting a mounting direction of a lever from a right direction and a left direction Further, according to the above configurations, the housing includes the lying wall parallel to the expanding-prevention portion, the notch portion is formed on the outer edge of the expanding-prevention portion, and the projection is projected toward the outside of the housing from the outer surface of the lever, and pressed and engaged with the notch portion so as not to rotate the lever. Accordingly, it is possible to simplify the structures of the lever fitting connector.

Further, according to the above configurations, the projection is arranged closer to the center of the lever than to the outer edge portion of the lever close to the mating connector. That is, the projection is arranged so as not to project toward a side of the fitting clearance between the mating connector and the projection. Thus, it is possible that the projection is prevented from being stuck with the wires and the housing of the mating connector, etc. Accordingly, it is possible to prevent the interference of the lever rotating operation.

Further, according to the above configurations, the U-shaped groove is provided on the lever to surround the projection, and the thickness of the inner portion of the U-shaped groove is made smaller than other portions of the lever to form the space between the inner portion of the U-shaped groove and the lying wall. Thus, the projection is bent toward the lying wall to release the engagement of the projection with the notch portion. Accordingly, it is possible to smoothly release the engagement of the projection with the notch portion, and perform the smooth rotating operation of the lever.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Hereinafter, a lever fitting connector 1 according to an embodiment of the present invention would be described with reference to FIG. 1 through FIG. 10.

Figure 1:
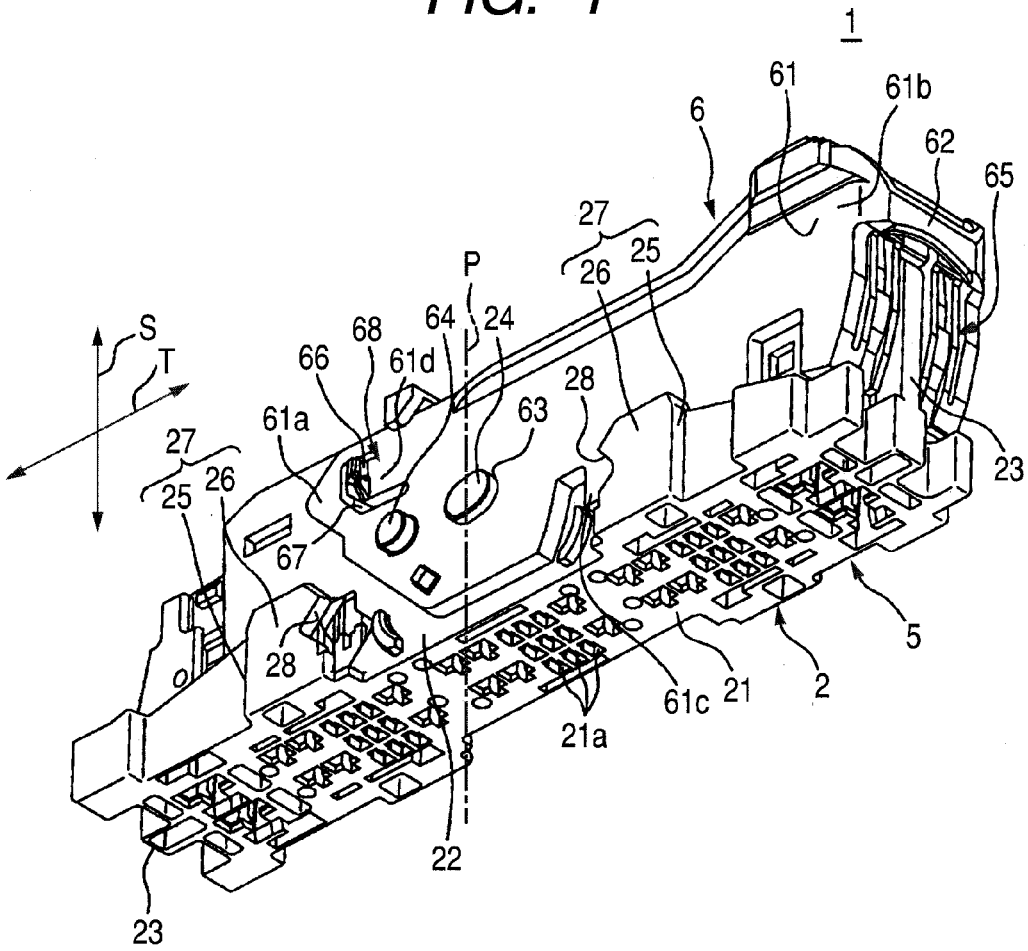
FIG. 1 is a perspective view showing a lever fitting connector according to an embodiment of the present invention.

The lever fitting connector 1 according to the embodiment as shown in FIG. 1 includes a male-typed connector 5, and a lever 6 pivotally mounted on an outer housing (housing) 2 of the connector 5. In the lever fitting connector 1, rotating the lever 6 connects/disconnects the connector 5 to/from a female-typed mating connector (not illustrated in figures), in fitting condition and in unfitting condition.

The term "connect/disconnect" indicates making one close to the other and making one away from the other. The term "connecting/disconnecting direction" is shown as an arrow S in FIG. 1, that is, indicates a moving direction in connecting and disconnecting of the connector 5 with respect to the mating connector. The term "perpendicular direction," which is perpendicular to the connecting/disconnecting direction S, is shown as an arrow T in FIG. 1.

The connector 5 includes an outer housing 2 made of synthetic resin, a plurality of inner housings 3 made of synthetic resin and contained in the outer housing 2, and a plurality of terminals 4 contained in the inner housings 3.

Figure 2:
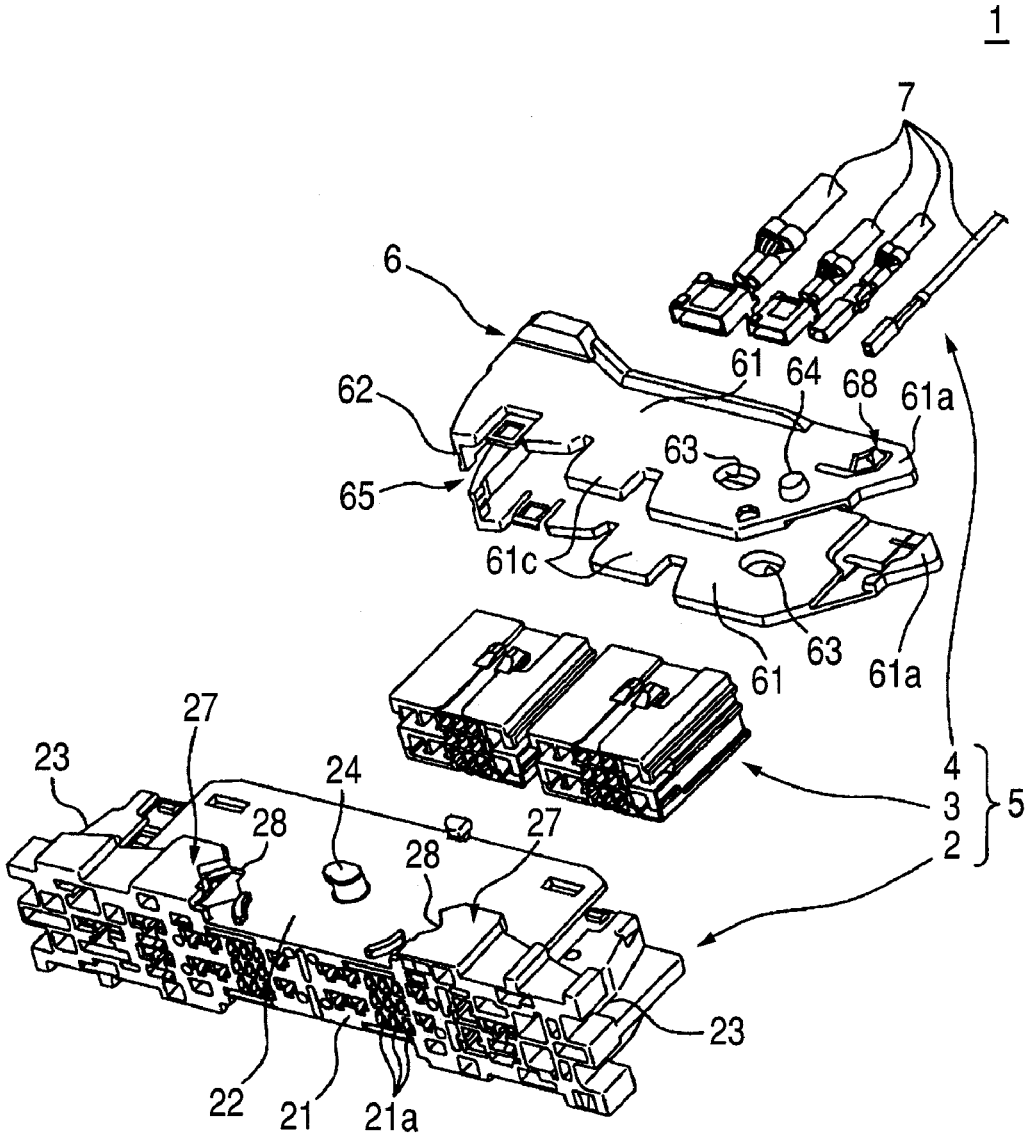
FIG. 2 is a disassembled perspective view of the lever fitting connector shown in FIG. 1.
Figure 3:
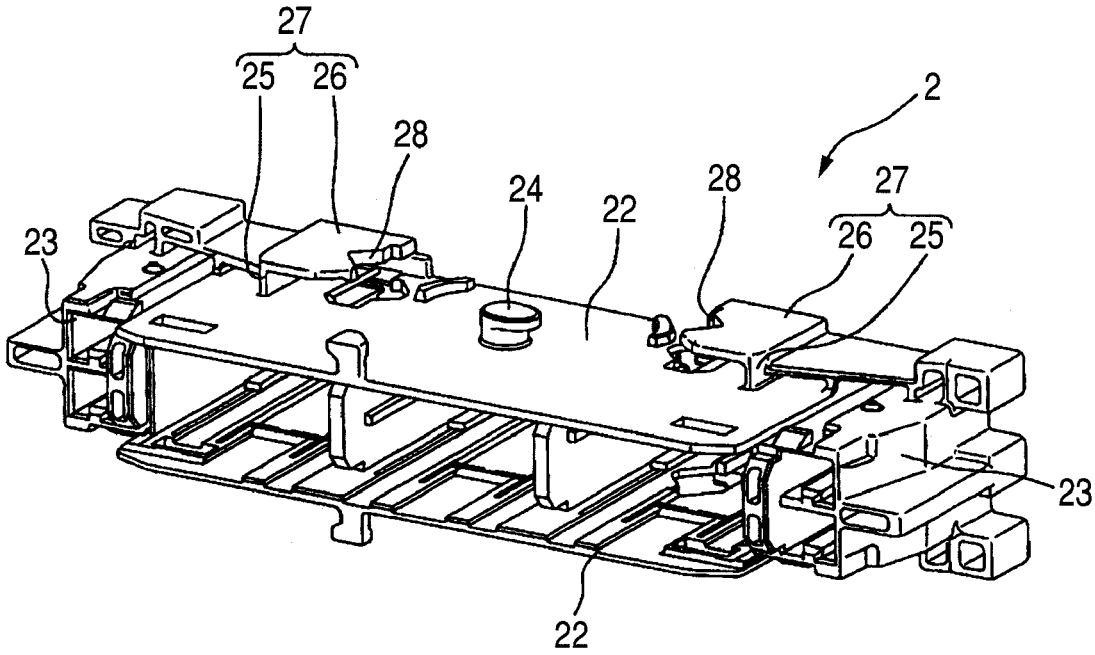
FIG. 3 is a perspective view showing an outer housing of the lever fitting connector shown in FIG. 1.
Figure 4:
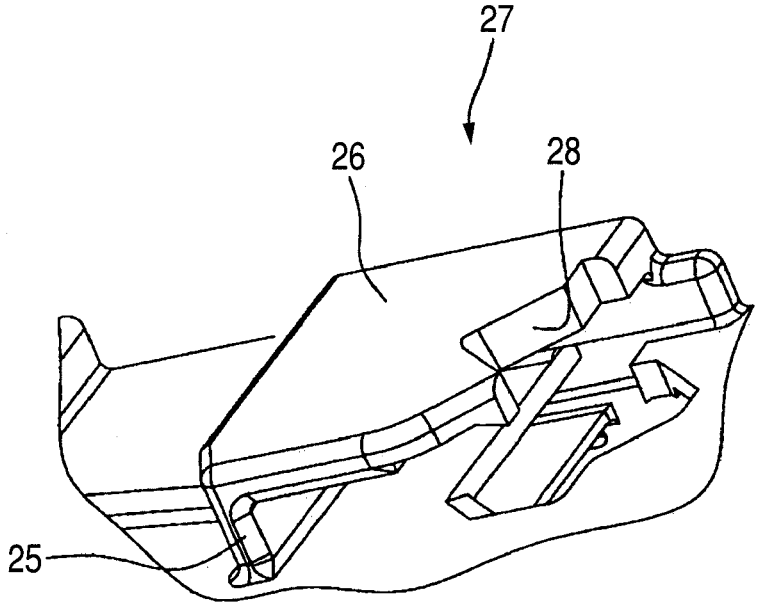
FIG. 4 is an enlarged view showing an expanding-prevention portion of the outer housing shown in FIG. 3.

The outer housing 2 includes, as shown in FIGS. 2 and 3, a bottom wall 21 arranged at a mating connector side, and four walls 22, 22, 23, 23 which are upstanding from the bottom wall 21. The walls 22, 22 and the walls 23, 23 are arranged in a separated manner and are parallel to each other, respectively. A width of the wall 22 along the perpendicular direction T is made larger than a width of the wall 23 (width in a direction perpendicular both the connecting/disconnecting direction S and the perpendicular direction T). The wall 22 is named as a lying wall 22, hereinafter. A side opposed to the bottom wall 21 of the outer housing 2 is open, and the plural inner housings 3 is inserted toward the bottom wall 21 from this opened side. The bottom wall 21 is provided with a plurality of through holes 21*a* into which terminals of the mating connector are inserted.

Figure 10A:
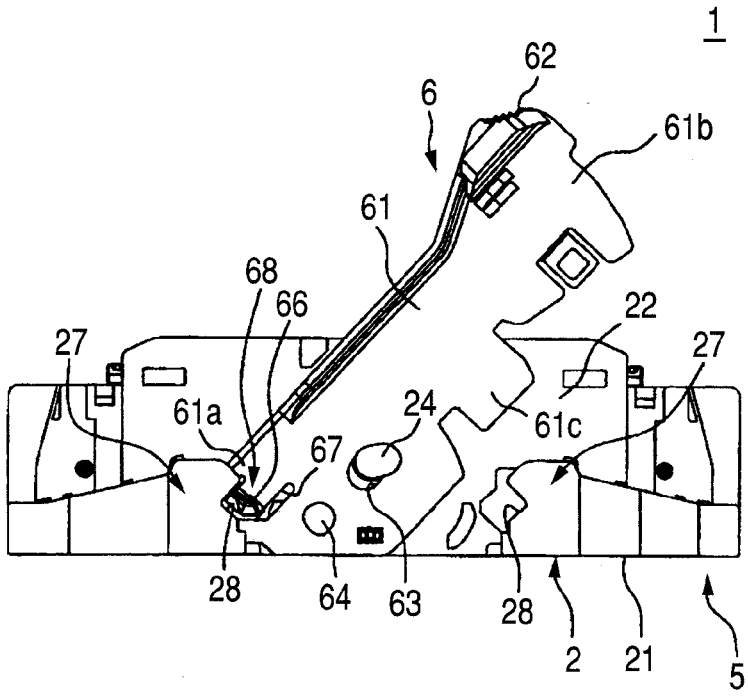
FIG. 10A is a plan view showing a state where the lever of the lever fitting connector shown in FIG. 1 is attached to the outer housing in one direction.
Figure 10B:
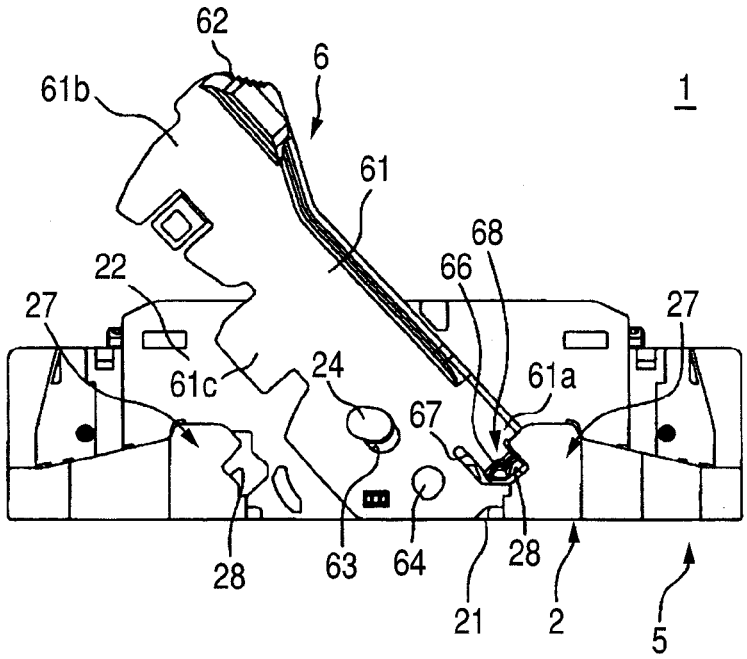
FIG. 10B is a plan view showing a state where the lever of the lever fitting connector shown in FIG. 1 is attached to the outer housing in another direction.
Figure 11:
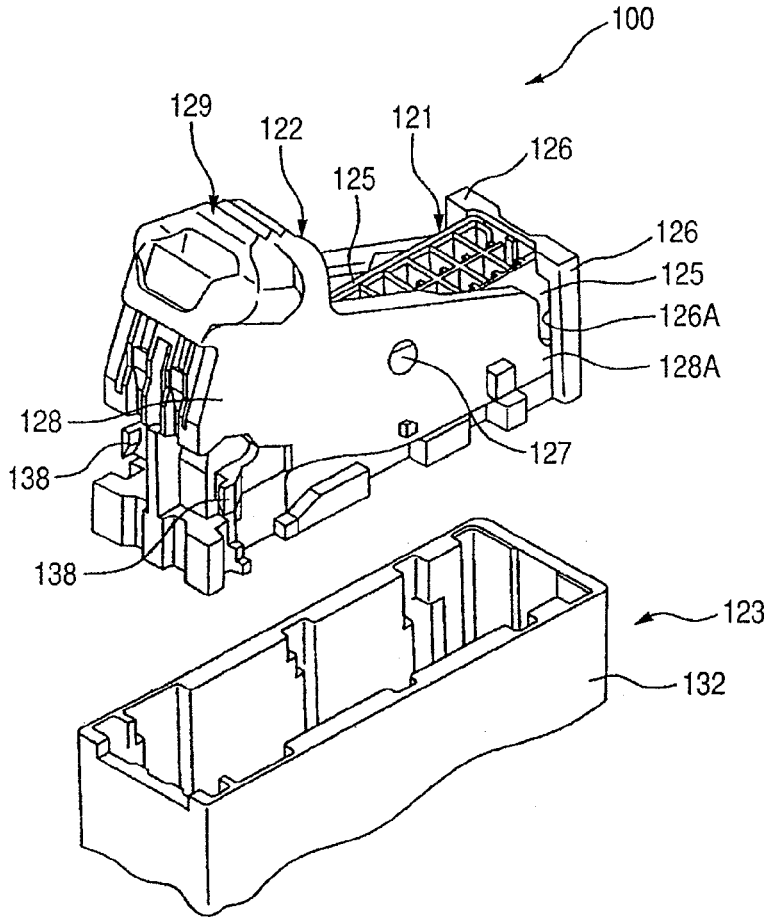
Related Art FIG. 11
FIG. 11 is an elevational view showing a lever fitting connector according to a background art.

A center supporting projection 24 (center supporting portion) is provided on an outer surface of the lying wall 22 to be passed through a center hole 63 arranged on the lever 6 so as to pivotally support the center hole 63 with respect to the lying wall 22. The center supporting projection 24 is provided at a center along the perpendicular direction T of the lying wall 22. In this way, since the center supporting projection 24 is provided at the center, it is possible to mount the lever 6 in both directions, that is, in one direction as shown in FIG. 10A and in the other direction reversed to the one direction in right and left as shown in FIG. 10B.

A pair of expanding-prevention portions 27 is provided on the outer surface of the lying wall 22 to prevent side plates 61 of the lever 6 from expanding toward an outside of the outer housing 2 due to the moment produced by a rotating operation of the lever 6. The pair of the expanding-prevention portions 27 is provided at a lower end along the connecting/disconnecting direction S of the lying wall 22, that is at an end close to the mating connector. The pair of the expanding-prevention portions 27 is symmetrically provided with respect to a virtual line P (shown by a dotted line in FIG. 1) parallel to the connecting/disconnecting direction through the center supporting projection 24, and is provided on a portion close to a center portion of the lying wall 22 along the perpendicular direction T. That is, the pair of the expanding-prevention portions 27 is provided in such a manner that the shape and arrangement thereof are symmetric with respect to the virtual line P. Further, the pair of the expanding-prevention portions 27 is provided, respectively, with an outstanding portion 25 which outstands from the outer surface of the lying wall 22, and a plate portion 26, an end of which is connected to the outstanding portion 25 and extended in parallel to the lying wall 22 in keeping a space between the lying wall 22 and the plate portion 26. The plate portions 26 are extended in an approach direction to each other.

Figure 6:
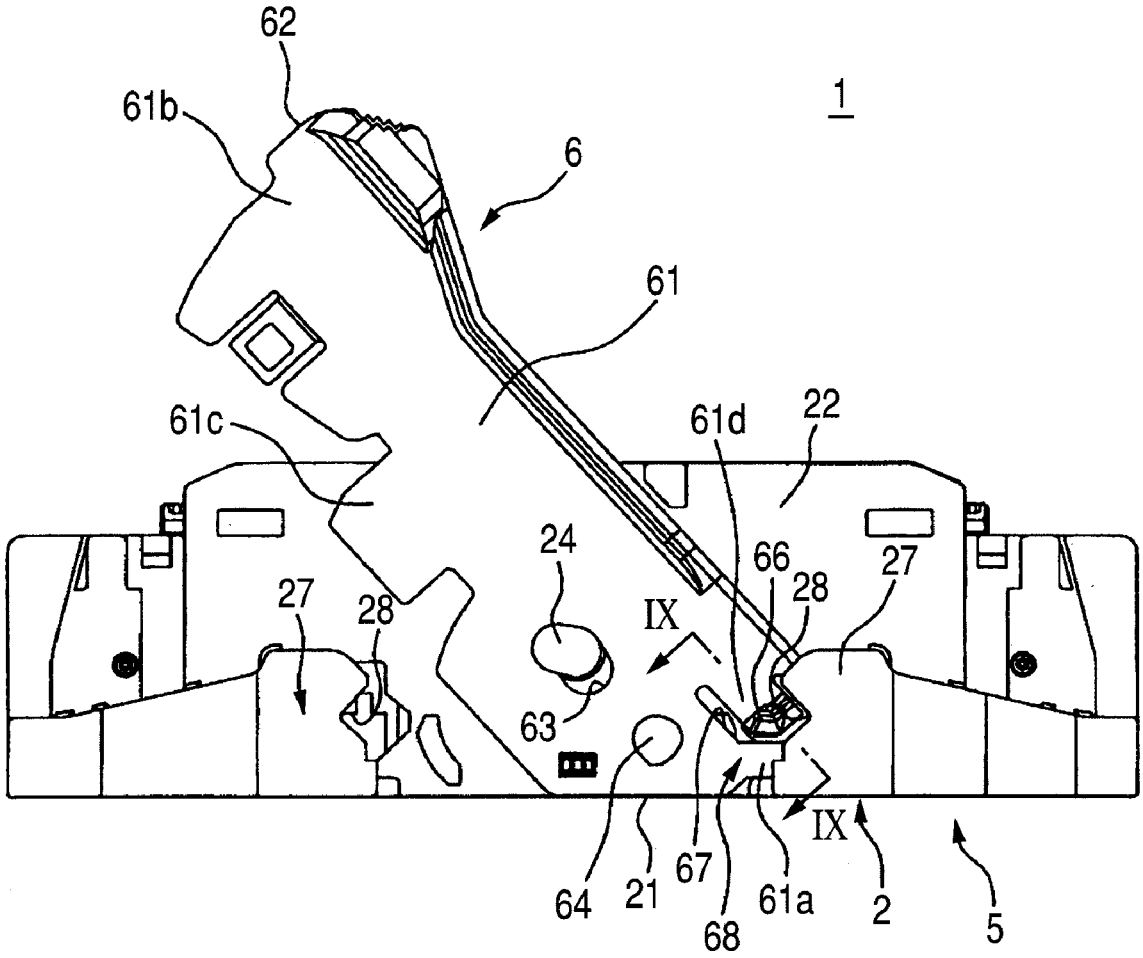
FIG. 6 is a plan view showing a state where the lever of the lever fitting connector shown in FIG. 1 positions a connector farthest away from a mating connector.
Figure 7:
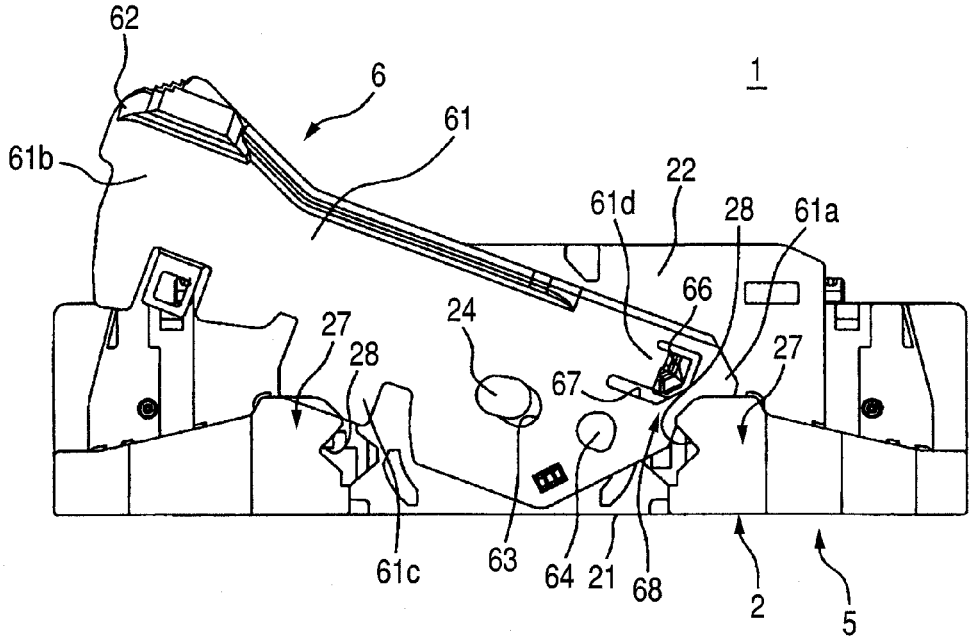
FIG. 7 is a plan view showing a state while the lever shown in FIG. 6 is rotating.
Figure 8:
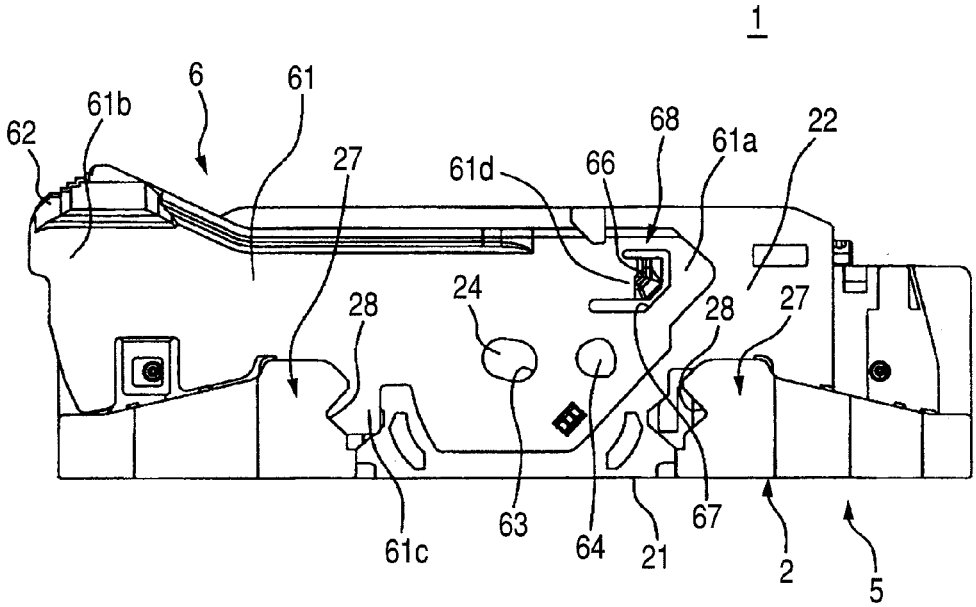
FIG. 8 is a plan view showing a state where the lever shown in FIG. 7 engages the connector with the mating connector.

The above-configured pair of the expanding-prevention portion 27 serves as follows. At first stage of the rotating operation of the lever 6, that is, in the rotating operation where the connector 5 is moved closer to the mating connector from a position where the connector 5 is farthest away from the mating connector (shown in FIG. 6), an outer edge portion 61*a* (one end potion 61*a*) of the side plate 61 is positioned between the plate portion 26 of one of the expanding-prevention portion 27 arranged at a right side in FIG. 6 and the lying wall 22. At last stage of the rotating operation of the lever 6, that is, in the rotating operation where the connector 5 is moved closer toward a fitting position shown in FIG. 8 from a position shown in FIG. 7, an outer edge portion 61*c* of the side plate 61 is positioned between the plate portion 26 of the other of the expanding-prevention portion 27 arranged at a left side in FIGS. 7, 8 and the lying wall 22. Further, as shown in FIG. 6, the outer edge portion 61*a* of the side plate 61 is positioned between the plate portion 26 of one of the expanding-prevention portions 27 and the lying wall 22 before rotating the lever. As shown in FIG. 8, the outer edge portion 61*c* of the side plate 61 is positioned between the plate portion 26 of the other of the expanding-prevention portions 27 and the lying wall 22 when rotating the lever 6 is finished. The outer edge portion 61*c* indicates a center portion along the perpendicular direction T of the side plate 61 and a lower portion of the side plate 61 close to the mating connector along the connecting/disconnecting direction S.

According to the embodiment, the pair of the expanding-prevention portions 27 is symmetrically provided with respect to the virtual line P on the above-mentioned position, that is, on the portions of the lying wall 22, the portions being lower end along the connecting/disconnecting direction S and close to a center along the perpendicular direction T. Thus, since the pair of the expanding-prevention potions 27 does not interfere the rotating operation of the lever 6, it is possible to mount the lever 6 in both directions, that is, in one direction as shown in FIG. 10A and in the other direction reversed to the one direction in right and left as shown in FIG. 10B.

The inner housing 3 is formed in box-shape, and includes a plurality of terminal container for containing the terminals 4. In the terminal container, one end along an inserting direction of the terminal 4 and the other end are communicated with an exterior space. The terminal container contains the terminals 4 from the one end, and contains terminals of the mating connector from the other end.

The terminal 4 is produced by press working of a conductive metal plate. The terminal 4 is connected to a terminal end of the wire 7. The terminal 4 is contained into the terminal container of the inner housing 3. The connector 5 is fitted to the mating connector. In this way, the terminal 4 is fitted and electrically connected to the terminal (not illustrated in figures) of the mating connector In the above-configured connector 5, the terminal 4 connected to the terminal end of the wire 7 is contained into the terminal container of the inner housing 3. Next, this inner housing 3 is contained and assembled into the outer housing 2.

Figure 5:
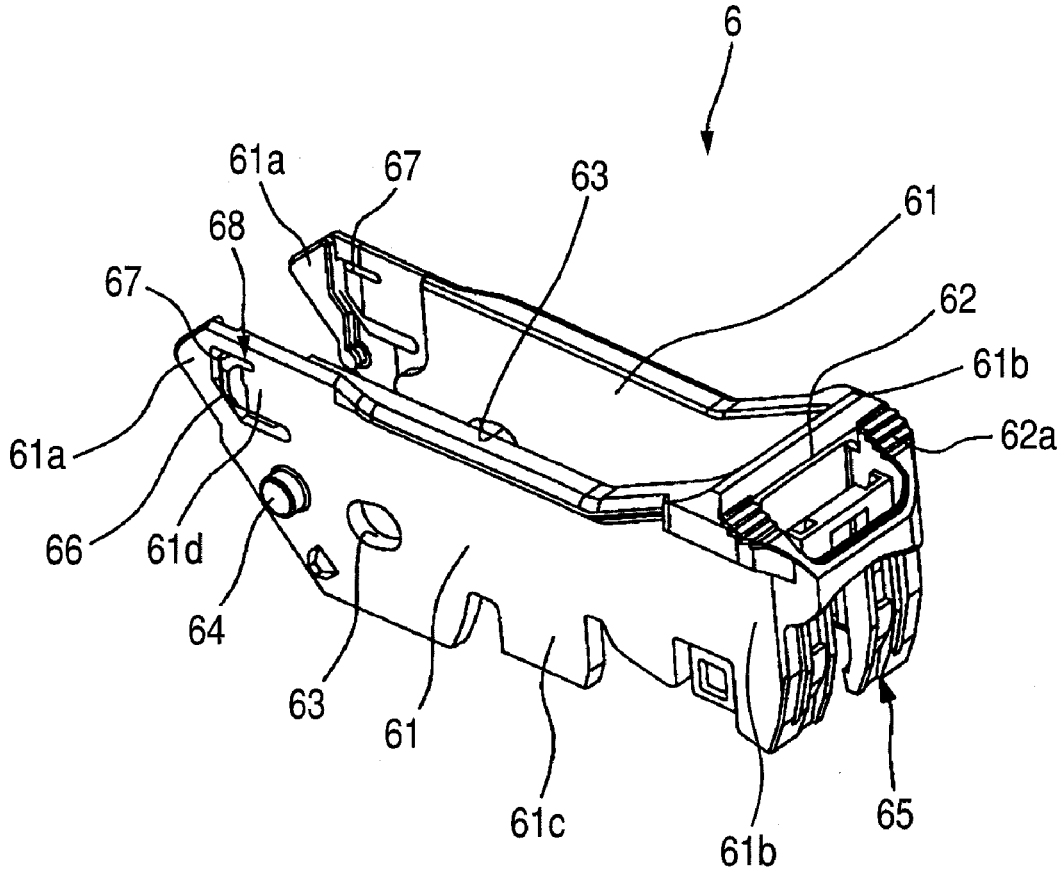
FIG. 5 is a perspective view showing a lever of the lever fitting connector shown in FIG. 1.

The lever 6 is made of an insulative synthetic resin as shown in FIG. 5. The lever 6 includes a pair of side plates 61 which are arranged in parallel and separated at one ends 61*a* each other, a connecting portion 62 which connects the other ends 61*b* of the pair of the side plates 61, a center hole 63 (center portion) which is provided at a side of the one ends 61*a* of the pair of the side plates 61, and a fulcrum portion 64 which is provided between the center hole 63 and the one end 61*a*.

The center hole 63 is a penetrated hole of the side plate 61. The center supporting projection 24 provided on the lying wall 22 is passed through the center hole 63. The lever 6 is pivotally supported by the center supporting projection 24. That is, the lever 6 is pivotally moved with respect to the center hole 63. An inner edge of the center hole 63 serves as point of load in the lever 6.

The fulcrum portion 64 projects from an outer surface of the side plate 61 in tubular. The fulcrum portion 64 serves as a fulcrum by being stuck with the housing of the mating connector. That is, The connector 5 is connected/disconnected to/from the mating connector by rotating the lever 6 in a state where the housing of the mating connector is stuck with the fulcrum portion 64.

A lock arm 65 is provided on the connecting portion 62. The lock arm 65 is engaged with the housing of the mating connector in a state where the connector 5 is fitted to the mating connector. In this way, the connector 5 is prevented from moving a separating direction from the mating connector when unintended force is applied to lever 6. An upper face 62*a* of the connecting portion 62 separated from the mating connector is a portion to which a load is applied when rotating the lever 6. The upper face 62*a* serves as point of effort.

The lever fitting connector 1 is provided with lever temporarily fixing means for keeping a balance of the lever 6 at an early stage of fitting the connector 5 to the mating connector. That is, the lever temporarily fixing means is provided to prevent the lever 6 from rotating in a state where the connector 5 is positioned farthest away from the mating connector (see FIG. 6). The lever temporarily fixing means includes a temporarily fixing arm 68 provided on the lever 6, and a notch portion 28 (see FIG. 4) which is formed in concave along a face direction of the lying wall from an outer edge of the expanding-prevention portion 27 and is formed as a result of notching a part of the expanding-prevention portion 27.

Figure 9:
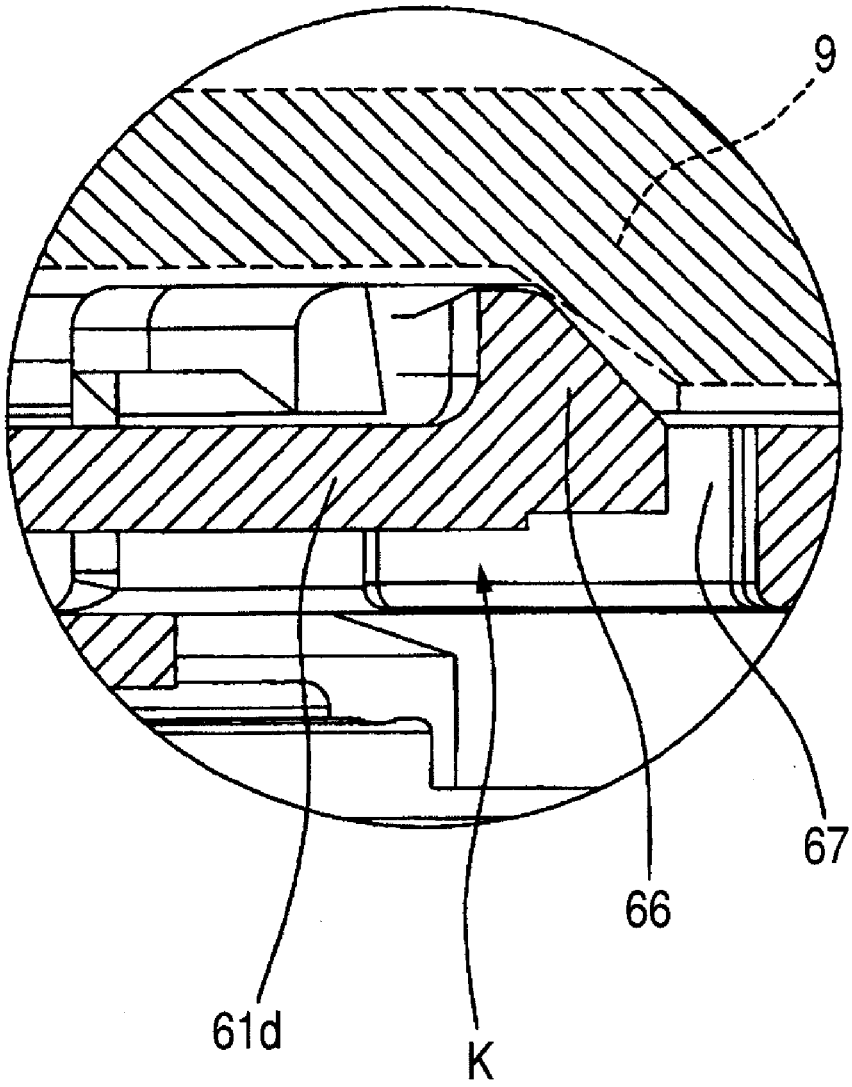
FIG. 9 is a sectional view along with a line IX-IX in FIG. 6.

The temporarily fixing arm 68 includes a projection 66 which projects toward an outside of the outer housing 2 from an outer surface in the vicinity of the one end 61*a* of the side plate 61, that is, from a position closer to a center of the side plate 61 than the outer edge 61*c* of the side plate 61 close to the mating connector, and a U-shaped groove 67 which is formed as a result of notching the side plate 61 in C-shape to surround the projection 66. The temporarily fixing arm 68 can be bended along a direction perpendicular to the surface direction of the side plate 61. Further, the thickness of a portion 61*d* inside the U-shaped groove 67 is made smaller than the other portion of the side plate 61. Thus, a space K is formed in which the projection 66 is bended toward a side of the lying wall 22, as shown in FIG. 9, between the portion 61*d* inside the U-shaped groove 67 and the lying wall 22.

In the above-configured temporarily fixing arm 68, as shown in FIG. 6, the projection 66 is pressed to engage with the notch portion 28 in a state where the connector 5 is positioned farthest away from the mating connector. In this way, the lever 6 is kept in rotating prevented state. When the connector 5 is to be fitted to the mating connector 5, the projection 66 pressed by the housing 9 of the mating connector is bent toward the side of the lying wall 22, and the engagement of the projection 66 with the notch portion 28 is released. In this way, the lever 6 is released from the rotating prevented state.

According to the invention, since the notch portion 28 is provided on the expanding-prevention portion 27, it is possible to simplify the configuration of the lever fitting connector 1.

According to the invention, since the temporarily fixing arm 68 is provided on a position closer to the center along the face direction of the side plate 61 than the outer edge 61*c* of the side plate 61 close to the mating connector, that is, since the temporarily fixing arm 68 is provided so as not to project toward a side of the fitting clearance between the mating connector and the temporarily fixing arm 68, it is possible to prevent the temporarily fixing arm 68 from being stuck with the wires 7 and the housing of the mating connector, etc.

According to the invention, since the space K is provided so that the projection 66 is bent toward the side of the lying wall 22, it is possible to smoothly release the engagement of the projection 66 with the notch portion 28. Thus, it is possible to smoothly perform the rotating operation of the lever 6.

An assembling method of the above-configured lever fitting connector 1 and a procedure of fitting of the connector 5 to the mating connector are described as follows. First, the inner housing 3 where the terminal 4 is inserted into the terminal container is attached into the outer housing. The one ends 61*a* of the side plates 61 of the lever 6 are outwardly expanded so that the lever 6 is elastically deformed. The center hole 63 is engaged with the center supporting projection 24. Then, the lever 6 is operated to press and engage the projection 66 to the notch portion 28. Thus, the lever 6 is in a rotating-disabled state.

Next, the connector 5 on which the lever 6 is mounted is made opposed to the mating connector, and these are moved close to each other. Then, the projection 66 pressed by the housing 9 of the mating connector is bent toward the side of the lying wall 22. The engagement of the projection with the notch portion 28 is released, and hence, the rotating-disabled state of the lever 6 is released. The force is applied on the upper surface 62*a* of the connecting portion 62 of the lever 6 toward the mating connector side from that state, the lever 6 starts to rotate around the center hole 63, and then, the fulcrum portion 64 is stuck with the housing of the mating connector. As the lever 6 is further rotated, the connector 5 is fitted to the mating connector and the terminals thereof are engaged with each other, the lock arm 65 is engaged with the housing of the mating connector, and the fitting of the connector 5 to the mating connector is finished.

When the connector 5 is disengaged from the mating connector, the lock arm 65 is bent to release the engaging state of the lock arm 65 with the connector of the mating connector. Then, when the lever 6 is rotated in a releasing direction reversed to the fitting direction of the lever 6, the connector 5 is released from the mating connector.

In the above-mentioned embodiment, the pair of the expanding-prevention portions 27 is symmetrically provided with respect to the virtual line P on the lower end of the lying wall 22 along the connecting/disconnecting direction S. However, according to the invention, the pair of the expanding-prevention portions 27 may be symmetrically provided with respect to the virtual line P on an upper end of the lying wall 22 along the connecting/disconnecting direction S.

It should be noted that the above-mentioned embodiment shows a representative embodiment according to the invention, and the present invention is not limited to the above-mentioned embodiment. That is, various modifications can be made within the scope of the invention without departing from the outline of the invention.

What is claimed is:

1. A lever fitting connector, comprising:

a connector having a housing;

a lever pivotally mounted on the housing and rotatable to connect/disconnect the connector to/from a mating connector;

a center portion provided on the lever to serve as a pivot location of the lever;

a center supporting portion provided on an outer surface of the housing at a center with respect to a direction perpendicular to a connecting direction of the connector toward the mating connector for pivotally supporting the center portion;

a pair of expanding-prevention portions symmetrically provided with respect to a virtual line extending parallel to the connecting direction of the connector through the center supporting portion so that the lever is prevented from deflecting with respect to the housing, the supporting portion and lever formed so that the lever may be operably mounted in alternative directions whereby it may be rotated in one or the other direction to draw the connector and mating connector together.

2. The lever fining connector according to claim 1, wherein the pair of the expanding-prevention portions are provided on one end of the housing, the end being in the connecting direction.

3. The lever fitting connector according to claim 1, wherein the housing includes a lying wall parallel to the expanding-prevention portions;

wherein edge portion of the lever is positioned between one of the expanding-prevention portions and the lying wall when the lever is rotated to an outermost position farthest from the mating connector; and wherein the edge portion of the lever is positioned between the other expanding-prevention portion and the lying wall when the lever is rotated to an innermost position closest to the mating connector.

4. The lever fitting connector according to claim 1, wherein the housing includes a lying wall parallel to the expanding-prevention portions;

wherein the rotation of the lever is split into a first stage and a last stage;

wherein an edge portion of the lever is positioned between one of the expanding-prevention portions and the lying wall at the first stage; and wherein the edge portion of the lever is positioned between the other expanding-prevention portion and the lying wall at the last stage.

5. The lever fining connector according to claim 1, wherein the housing includes a lying wall parallel to the expanding-prevention portions;

wherein a notch portion is formed on an outer edge of the expanding-prevention portions; and wherein a projection is projected toward an outside of the housing from an outer surface of the lever, and pressed and engaged with the notch portions to prevent rotation of the lever.

6. The lever fining connector according to claim 5, wherein the projection is arranged closer to a center of the lever than to an outer edge portion of the lever close to the mating connector.

7. The lever fining connector according to claim 5, wherein a U-shaped groove is provided on the lever to surround the projection; and wherein a thickness of an inner portion of the U-shaped groove is made smaller than other portions of the lever to form a space between the inner portion of the U-shaped groove and the lying wall.

8. The lever fining connector according to claim 1, wherein the pair of expanding-prevention portions are symmetrically provided with respect to a virtual line extending parallel to the connecting direction of the connector, the virtual line extending through the center of the outer surface of the housing with respect to the direction perpendicular to the connecting direction.

9. The lever fining connector according to claim 1, wherein the shape of the connector is symmetric with respect to the pivot location of the lever.

10. The lever fining connector according to claim 3, wherein the width of the lying wall is larger than a width of a wall perpendicular to the lying walls.

11. The lever fitting connector according to claim 1, wherein the housing includes a lying wall parallel to the expanding-prevention portions;

wherein a first edge portion of the lever is positioned between an expanding-prevention portion and the lying wall when the lever is rotated to an outermost position farthest from the mating connector and a second edge portion is not positioned between either expanding-prevention portions and the lying wall;

wherein the second edge portion of the lever is positioned between an expanding-prevention portion and the lying wall and the first edge portion of the lever is not positioned between either expanding-prevention portions and the lying wall when the lever is rotated to an innermost position closest to the mating connector; and wherein a first edge portion of the lever is positioned between an expanding-prevention portion and the lying wall and the second edge portion of the lever is positioned between the other expanding-prevention portion and the lying wall for approximately the entire rotation from the outermost position to the innermost position.

12. The lever fitting connector according to claim 1, wherein the housing includes a lying wall parallel to the expanding-prevention portion;

wherein the rotation of the lever is split into a first, intermediate, and last stage;

wherein a first edge portion of the lever is positioned between an expanding-prevention portion and the lying wall and a second edge portion is not positioned between either of the expanding-prevention portions and the lying wall in the first stage;

wherein the second edge portion of the lever is positioned between an expanding-prevention portion and the lying wall and the first edge portion of the lever is not positioned between either of the expanding-prevention portions and the lying wall in the last stage; and wherein a first edge portion of the lever is positioned between an expanding-prevention portion and the lying wall and the second edge portion of the lever is positioned between the other expanding-prevention portion and the lying wall in the intermediate stage.

13. The lever fitting connector according to claim 1, wherein a notch portion is formed on each of the expanding-prevention portions, and wherein a projection extends from an outer surface of the lever to engage with the notch portions to prevent rotation of the lever.

* * * * *